US007636043B2

(12) United States Patent
Super

(10) Patent No.: US 7,636,043 B2
(45) Date of Patent: Dec. 22, 2009

(54) METHOD AND APPARATUS FOR IMPROVING THE ACCURACY OF SECURITY SYSTEMS

(75) Inventor: Boaz J. Super, Westchester, IL (US)

(73) Assignee: General Instrument Corporation, Horsham, PA (US)

( * ) Notice: Subject to any disclaimer, the term of this patent is extended or adjusted under 35 U.S.C. 154(b) by 714 days.

(21) Appl. No.: 11/477,878

(22) Filed: Jun. 29, 2006

(65) Prior Publication Data

US 2008/0001738 A1 Jan. 3, 2008

(51) Int. Cl.
*G08B 13/00* (2006.01)

(52) U.S. Cl. ..... 340/541; 340/572.1; 340/573.1

(58) Field of Classification Search ..... 340/541, 340/521, 522, 524, 539.1, 539.13, 572.1, 340/573.1, 568.1, 10.1; 700/245, 247; 701/207; 707/10

See application file for complete search history.

(56) References Cited

U.S. PATENT DOCUMENTS 6,687,386 B1 * 2/2004 Ito et al. ..... 382/103
6,720,876 B1 * 4/2004 Burgess ..... 340/568.1
7,289,881 B2 * 10/2007 Ota et al. ..... 700/245
2006/0138220 A1 * 6/2006 Persky ..... 235/383
2006/0277202 A1 * 12/2006 Dempsey ..... 707/10

* cited by examiner

*Primary Examiner*—Van T. Trieu
(74) *Attorney, Agent, or Firm*—Stewart M. Wiener

(57) ABSTRACT

A security system is provided that uses two or more object-locating systems to determine whether a sensed object is a household member or an intruder. One of the object-locating systems locates "cooperative" objects, which are household members that wear or carry a device that communicates with the system to allow the system to determine the locations of the household members. Another of the object-locating systems locates non-cooperative objects, such as intruders, and typically also locates the cooperative objects. When an object is located by the second object-locating system, the security system of the invention determines whether the object location corresponds to a location of a cooperative object as determined by the first object-locating system. If so, the security system decides that the object is a household member and does not trigger the alarm. If not, the security system decides that the object is an intruder and may trigger the alarm.

24 Claims, 5 Drawing Sheets

METHOD AND APPARATUS FOR IMPROVING THE ACCURACY OF SECURITY SYSTEMS

TECHNICAL FIELD OF THE INVENTION

The invention relates to security systems and improving the accuracy of security systems.

BACKGROUND OF THE INVENTION

A major source of dissatisfaction with home security systems is that motion sensors of the systems are often triggered by pets or members of the household. When false alarms occur, they unnecessarily put people in the home in fear. False alarms sometimes also result in monetary fines being charged to the homeowner or renter, as well as loss of credibility of the homeowner or renter with emergency responders. As a result, some people disable the motion sensors of their security system, thus compromising their own security.

Current techniques for preventing false alarms caused by pets or family members have significant limitations. One known technique for preventing false alarms from being triggered by pets or family members relies on aiming the motion sensors of the security system above the height of pets so that they do not sense the pets' motion as they move around the home. This technique can work suitably for dogs, but can easily be defeated by a crawling intruder, and can be triggered by cats and other animals that climb. Another known technique relies on processing the projected sizes of objects on a sensor to determine whether the objects correspond to pets or intruders. This technique does not work well with large animals or when multiple animals are in close proximity to one another. Also, because the projected size of an object on a sensor will vary depending on how close to or how far away the object is from the sensor, the decisions that are made based on the projected size are not always accurate.

Accordingly, a need exists for way to determine when a security system sensor has sensed pets or family members as opposed to intruders so that the security system alarm is not triggered by pets or family members.

SUMMARY OF THE INVENTION

The invention provides a method and an apparatus for improving the accuracy of security systems. The apparatus comprises an input/output (I/O) interface and a processor. The I/O interface is configured to receive object location information from a first object-locating system and from a second object-locating system. The first object-locating system is capable of locating at least cooperative objects. The second object-locating system is capable of locating at least non-cooperative objects. A cooperative object is an object that cooperates with the apparatus by emitting or transmitting at least one signal from a signal emitting or transmitting device that is on or in the cooperative object to the first object-locating system to enable the first object-locating system to locate the cooperative object. A non-cooperative object is an object that is not a cooperative object. The object location information received by the I/O interface from the first object-locating system describes a location of a cooperative object in at least one dimension. The object location information received by the I/O interface from the second object-locating system describes a location of a non-cooperative object in at least one dimension.

The processor is configured to perform an object-type determination (OTD) algorithm, which processes the object location information to determine whether the location of the cooperative object is the same or substantially the same as the location of the non-cooperative object. If the processor determines that the location of the cooperative object is the same or substantially the same as the location of the non-cooperative object, the processor decides that the cooperative object and the non-cooperative object are the same object. If the processor determines that the location of the cooperative object is not the same or substantially the same as the location of the non-cooperative object, the processor decides that the cooperative object and the non-cooperative object are not the same object.

The method comprises receiving object location information from the first object-locating system and from a second object-locating system, and processing the object location information received from the first and second object-locating systems to determine whether or not the location of the cooperative object is the same or at least substantially the same as the location of the non-cooperative object. If a determination is made that the location of the cooperative object is the same or substantially the same as the location of the non-cooperative object, a decision is made that the cooperative object and the non-cooperative object are the same object. If a determination is made that the location of the cooperative object is not the same or substantially the same as the location of the non-cooperative object, a decision is made that the cooperative object and the non-cooperative object are not the same object.

In accordance with an embodiment of the invention, the algorithm is implemented as a computer software program embodied on a computer-readable medium. The program comprises instructions for receiving object location information from the first object-locating system and from a second object-locating system, and instructions for processing the object location information received from the first and second object-locating systems to determine whether or not the location of the cooperative object is the same or at least substantially the same as the location of the non-cooperative object. If it is determined that the location of the cooperative object is the same or substantially the same as the location of the non-cooperative object, then a decision is made that the cooperative object and the non-cooperative object are the same object. If it is determined that the location of the cooperative object is not the same or substantially the same as the location of the non-cooperative object, then it is decided that the cooperative object and the non-cooperative object are not the same object.

These and other features and advantages of the invention will become apparent from the following description, drawings and claims.

DETAILED DESCRIPTION OF AN EXEMPLARY EMBODIMENT

The invention is directed to a security system that uses two or more object-locating systems to determine whether a sensed object is a household member or an intruder. Household members include pets and/or human beings living in the home. One of the object-locating systems locates "cooperative" objects, which are household members. These objects are cooperative in that the household members wear or carry a device that communicates with the system to allow the system to determine the locations of the household members. Another of the object-locating systems locates non-cooperative objects, such as intruders, and typically also locates the cooperative objects. When an object is located by the second object-locating system, the security system of the invention determines whether the object location corresponds to a location of a cooperative object as determined by the first object-locating system. If so, the security system decides that the object is a household member and does not trigger the alarm. If not, the security system decides that the object is an intruder and may trigger the alarm. Optionally, the certainty of the decision may also be used to determine what if any action is to be taken. For example, a different type of alarm may be triggered by the system in borderline cases in which it cannot be decided with total certainty whether or not the object is a household member or an intruder.

Figure 1:
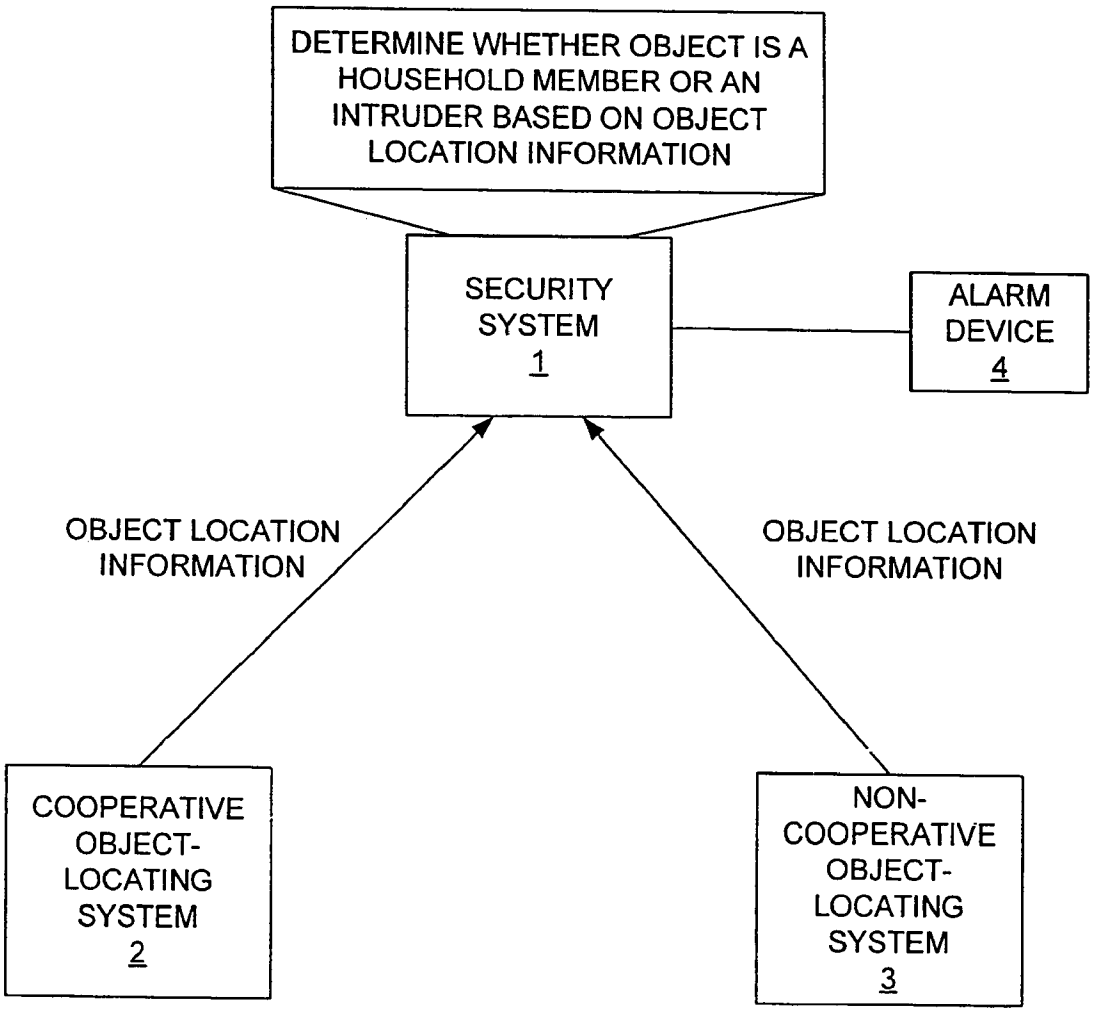
FIG. 1 illustrates the security system of the invention in accordance with an embodiment that receives information from a first object-locating system and from a second object-locating system.

FIG. 1 illustrates the security system 1 of the invention in accordance with an embodiment that receives information from a first object-locating system 2 and from a second object-locating system 3. The first object-locating system 2 locates cooperative objects. The second object-locating system 3 locates non-cooperative objects and typically also locates cooperative objects. Both systems 2 and 3 send object location information to the security system 1, which then performs the algorithm of the invention to determine whether the object is a household member or an intruder, and either activates or does not activate an alarm device 4 in accordance with the determination.

The first object-locating system 2 may be any type of object-locating system that is capable of locating cooperative objects, which are household members in the exemplary embodiment. It should be noted that the phrase "household member", as that phrase is used herein, is intended to denote human beings that live in the home, visitors who are allowed by the head of the household to be in the home, household pets, household robots, household appliances, etc.

The second object-locating system 3 may also be any type of object-locating system that is capable of locating non-cooperative objects within the home. A variety of such systems exist and are currently available. These systems include, for example, passive infrared (IR) systems, active IR systems, laser systems, imaging systems, etc. The invention is not limited to any particular system or technique for locating non-cooperative objects. Of course, these systems will typically also locate cooperative objects because the mere fact that an object cooperates with the first object-locating system 2 will not prevent the object from being located by the second object-locating system 3.

Preferably, the first object-locating system 2 uses radio frequency (RF) signals to locate household members. RF signals that uniquely identify a household member are emitted from and/or reflected by the household member and are received by one or more RF receivers installed within the home. The receivers decode the received signal and determine the location of the household member based on the decoded signal. The receivers may be part of respective transceivers.

Figure 2:
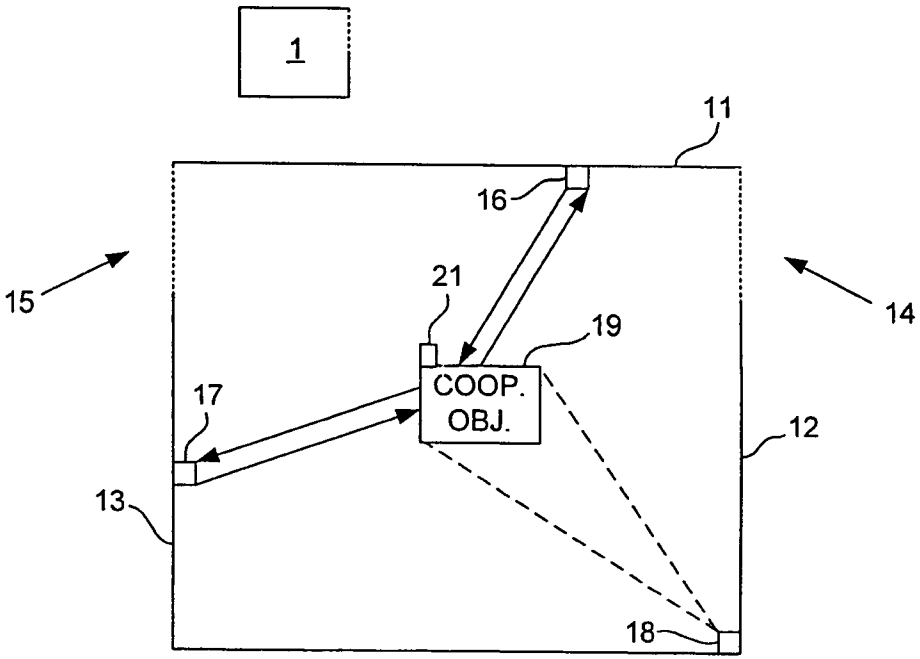
FIG. 2 illustrates a two-dimensional (2-D) top-view diagram of a room of a house in which the first and second object-locating systems shown in FIG. 1 are installed, which both detect a cooperative object.

FIG. 2 illustrates a two-dimensional (2-D) top-view diagram of a room of a house in which both of the object-locating systems 2 and 3 are installed. In this example, the object-locating systems 2 and 3 locate a cooperative object 19. The room has three walls 11, 12 and 13, a ceiling (not shown), and two doorways 14 and 15. In this example, the cooperative object-locating system 2 includes a first RF transceiver 16 and a second RF transceiver 17. It should be noted, however, that this arrangement of transceivers is not necessary to the invention, as will be described below in more detail.

In this example, the second object-locating system 3 uses an imaging system 18, e.g., a camera, that is capable of locating the cooperative object 19 by capturing one or more images of an object and processing the image or images to determine the location of the object 19. The "location" of an object, as that term is used herein, is intended to mean the position of an object in at least one dimension. As stated above, a variety of systems are available that are capable of determining the location of an object. The location information is then transmitted by the imaging system 18 over a wired or wireless link to the security system 1 of the invention, which may be located in a different room of the house, as shown.

The transceivers 16 and 17 of the first object-locating system 2 may be, for example, RF identification (RFID) transceivers that send RF signals to the cooperative object 19. In this case, the cooperative object 19 is wearing or carrying an RFID device 21 that responds to the RF signals transmitted by the RFID transceivers by outputting an RFID response signal. RFID devices typically do not require a power supply because they obtain their power from the signal received from the RFID transceiver. However, self-powered RFID devices may also be used. The RFID response signal includes a code that uniquely identifies the cooperative object 19. The RFID transceivers 16 and 17 receive the response signal, decode it, process the code, identify the object 19, and determine the location of the object. This location information is then transmitted over one or more electrical wires (not shown) or wirelessly to the security system 1 of the invention.

In accordance with an alternative embodiment, the cooperative object 19 is wearing or carrying an RF transmitter (not shown) instead of an RFID device, and the transceivers 16 and 17 are RF transceivers instead of RFID transceivers. The RF transmitter transmits an RF signal that is received, decoded and processed by the transceivers 16 and 17 to identify the object and determine the location of the object.

As described above with reference to FIG. 1, the security system 1 processes the object location information received from both systems and determines whether or not the object 19 detected by both systems is in the same location, which is true in this case. Because the object 19 is a cooperative object, the system 1 will determine that the object is a household member and not an intruder, and thus will not activate the alarm.

A variety of RF object locating techniques can be used by the cooperative object-locating system 2 to locate the object 19. Such RF techniques include, but are not limited to, techniques that use the Doppler effect and techniques that use triangulation. Also, while it is preferable for the RF signals to be coded to enable the cooperative object to be uniquely identified, this is not necessary to the successful operation of the invention. For example, in the case in which a single household member is to be located by the object-locating system 2, non-coded RF signals can be used to locate the cooperative object 19. However, for additional security reasons, it is preferred that the RF signal is coded in order to make it more difficult for an intruder to reproduce an RF signal that might fool the security system into making a determination that an intruder is a household member. The cooperative object 19 may be wearing or carrying a battery-powered RF device (not shown) that transmits an RF signal of a particular frequency. The transceivers 16 and 17 may instead be only receivers that receive the RF signals transmitted by the RF device and process the signals in accordance with, for example, a Doppler effect algorithm or a triangulation algorithm, to determine the location of the object.

Another alternative to using RFID techniques is to use a technique by which the cooperative object 19 transmits its own location in the house to the security system 1. For example, Global Positioning Satellite (GPS) technology may be used to locate the cooperative object 19 within the house. The security system 1 will then compare the GPS location information with the location information provided by the second object-locating system 3 and decide whether or not the location information defines the same location within the house.

Figure 3:
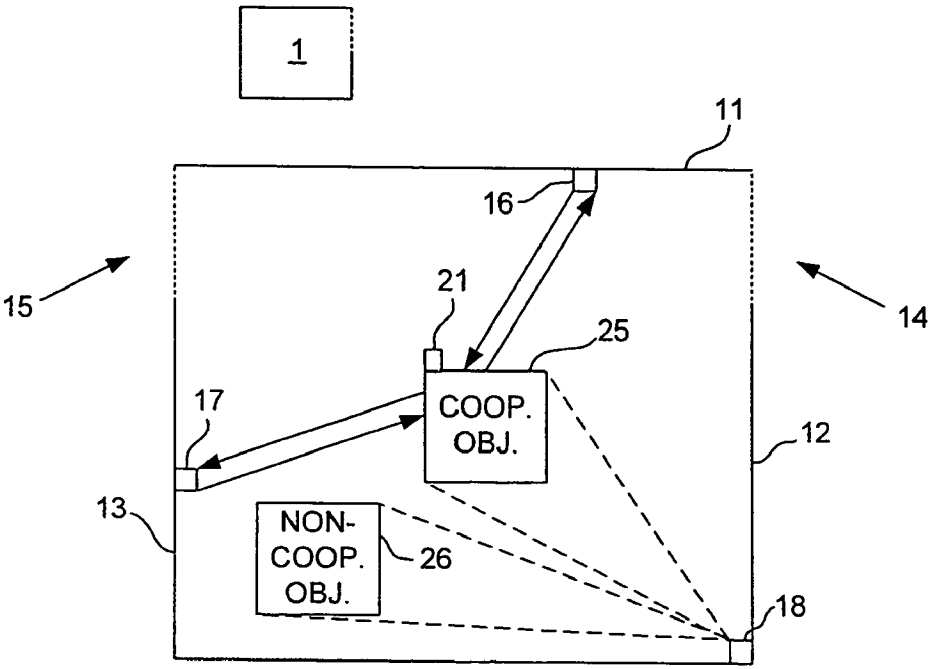
FIG. 3 illustrates a two-dimensional (2-D) top-view diagram of a room of a house in which the first and second object-locating systems shown in FIG. 1 are installed, and wherein the second object-locating system locates a non-cooperative object that is not in the same location as a cooperative object located by the first object-locating system.

FIG. 3 illustrates a two-dimensional (2-D) top-view diagram of a room of a house in which both of the object-locating systems 2 and 3 are installed, and which locate a cooperative object 25 and a non-cooperative object 26, respectively. As in the example described above with reference to FIG. 2, in this example the cooperative object-locating system 2 includes a first RF transceiver 16 and a second RF transceiver 17, and the second object-locating system 3 uses an imaging system 18. The transceivers 16 and 17 and the imaging system 18 operate in the same manner described above with reference to FIG. 2. However, the imaging system 18 locates both the cooperative object 25 and the non-cooperative object 26. The transceivers 16 and 17 locate only the cooperative object 25. The location information obtained by the transceivers 16 and 17 and the location information obtained by the imaging system 18 is transmitted to the security system 1. The security system 1 processes the location information and determines that the location information obtained by the transceivers 16 and 17 and by the imaging system 18 indicate that the cooperative object 25 located by both systems is in the same location. However, the security system 1 also determines that the location information regarding non-cooperative object 26 obtained by imaging system 18 does not correspond to the location information regarding cooperative object 25 obtained by transceivers 16 and 17. Thus, the security system 1 will decide that the cooperative object 25 and the non-cooperative object 26 are not the same object. The security system 1 will then cause the alarm device 4 to be activated, or some other action to occur.

Figure 4:
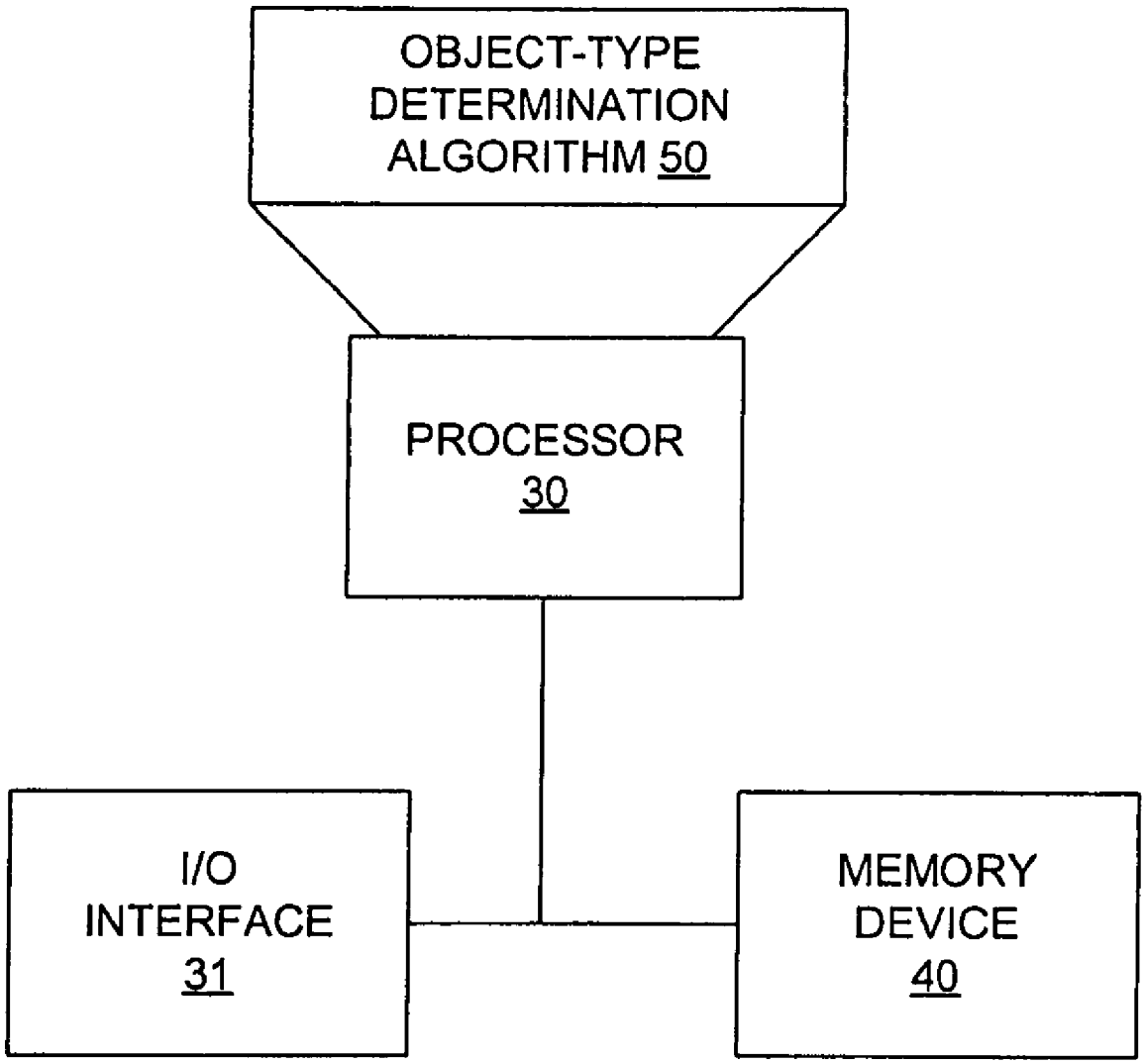
FIG. 4 illustrates a block diagram of the apparatus 20 of the invention in accordance with an exemplary embodiment, which is implemented in the security system shown in FIG. 1.

FIG. 4 illustrates a block diagram of the apparatus 20 of the invention in accordance with an exemplary embodiment, which is implemented in the security system 1. The apparatus 20 includes a processor 30, and input/output (I/O) interface 31 and a memory device 40. The processor 30 performs an Object-Type Determination (OTD) algorithm 50. As described in more detail below with reference to FIG. 5, the OTD algorithm 50 receives the object location information from the object-location systems 2 and 3, processes the information to determine whether or not the location information from each system describes the object as being in the same location, or substantially the same location, and activates the alarm or does not activate the alarm based on the determination. The I/O interface 31 receives the location information from the systems 2 and 3 and forwards it to the processor 30. The I/O interface 31 may also send signals generated by the processor 30 to the systems 2 and 3, such as polling or control signals, for example. The I/O interface 31 also sends an alarm activation signal to the alarm device 4 if the processor 30 determines that the detected object is an intruder. The interface 31 typically will also send a signal to a security monitoring service (not shown) that monitors the home if the processor 30 determines that the detected object is an intruder.

The processor 30 may be any type of computational device, including, for example, a microprocessor, a microcontroller, a programmable gate array, a programmable logic array, an application specific integrated circuit (ASIC), a system on a chip (SOC), etc. The algorithm 50 is typically implemented as a software computer program executed by the processor 30. The program may be stored in memory device 40, which may be any type of computer-readable medium, including, for example, random access memory (RAM), dynamic RAM (DRAM), flash memory, read only memory (ROM) compact disk ROM (CD-ROM), digital video disks (DVDs), magnetic disks, magnetic tapes, etc. The invention also encompasses electrical, optical and acoustical signals modulated on appropriate carriers (e.g., electrical conductors, wireless carrier waves, optical waveguides, acoustical waveguides, etc.) in packets and in non-packet formats. The algorithm 50 may also be implemented in hardware, or in a combination of hardware and software or firmware.

Figure 5:
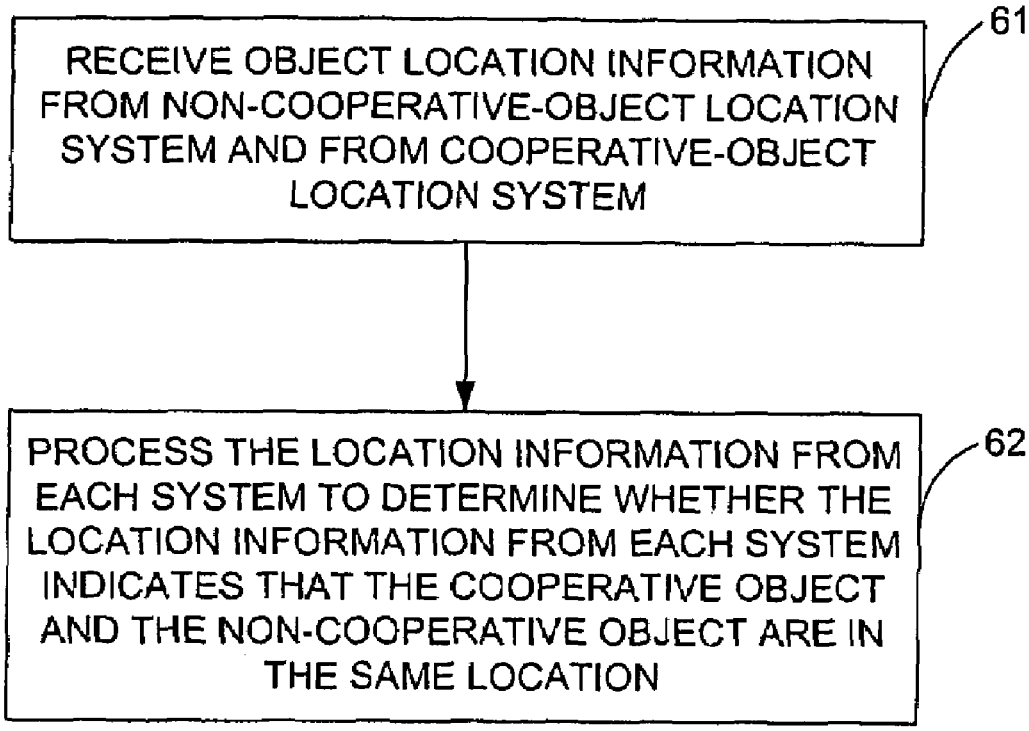
FIG. 5 illustrates a flowchart that demonstrates the method of the invention performed by the algorithm being executed by the processor shown in FIG. 4 in accordance with an embodiment.

FIG. 5 illustrates a flowchart that demonstrates the method of the invention performed by the algorithm 50 being executed by the processor 30 in accordance with an embodiment. The processor 30 receives the object location information from each of the non-cooperative object locating system 3 and from the cooperative object locating system 2, as indicated by block 61. The object location information from the cooperative-object locating system 2 describes the location of a cooperative object. The object location information from the non-cooperative object locating system 3 describes the location of a non-cooperative object. The processor 30 processes the object location information to determine whether or not the object location information from each system 2 and 3 indicates the cooperative object and the non-cooperative object are in the same, or substantially the same, location, as indicated by block 62. For example, the distance between the two locations can be calculated and the two locations considered substantially the same if this distance is less than a predefined threshold. Of course, there are other techniques that can be used to determine whether the locations are substantially the same.

If the processor 30 determines that the cooperative and the non-cooperative objects are not in the same location, or in substantially the same location, depending on how much tolerance is allowed, the processor 30 outputs a signal to the security system 1, which causes the alarm device 4 to be activated. If the processor 30 determines that the cooperative and the non-cooperative objects are in the same location, or in substantially the same location, the processor 30 may output a signal to the security system 1 to prevent it from activating the alarm device 4. One or the other or both of these actions may be taken by the processor 30, depending on how the security system 1 is configured. For example, it may not be necessary for the processor 30 to output a signal to prevent the alarm device from being activated, but only to output a signal if the alarm device is to be activated, or vice versa.

It should be noted that while the invention has been described as using a single cooperative object locating system 2 and a single non-cooperative object locating system 3, multiple cooperative object locating systems and/or multiple non-cooperative object locating systems could be used. The exemplary embodiments described above are used for the purpose of demonstrating that at least one of each type of system is used. Also, while the invention has been described with reference to its use in a home, the invention applies equally to other environments, such as offices, stores, etc., where after hours only authorized persons are allowed or expected to be on the premises. In addition, while the invention has been described for exemplary purposes as being used inside of a home, the invention may also be used outside of the home.

In accordance with another aspect of the invention, the security system 1 performs an Object-Locating (OL) algorithm that determines whether or not it is able to locate a cooperative object. If, for example, a pet wearing a collar that has an RFID device attached to it leaves the premises, the cooperative object-locating system 2 will no longer be able to detect the pet. The security system 1 will then provide some indication to the head of the household or other responsible person that the pet or the pet's collar cannot be located. This information may be used by the owner of the pet to cause a search for the pet or for the pet's collar to be conducted. The device worn by the cooperative object does not have to be an RFID device, but can be any device capable of transmitting a signal that uniquely identifies the object to the object-locating system 2, such as, for example, other types of devices that transmit coded RF signals, devices that transmit IR signals in a way that uniquely identifies the object, etc. Also, the device worn by the object may transmit periodically or only upon being polled by the object-locating system 2. The OL algorithm may be part of the OTD algorithm 50 described above or it may be a separate algorithm. In either case, the OL algorithm will typically be performed by the apparatus 20 described above with reference to FIG. 4.

It should be noted that the invention has been described with reference to particular embodiments and that the invention is not limited to these embodiments. Those skilled in the art will understand, in view of the description provided herein, that variations can be made to the embodiments described herein and that all such variations are within the scope of the invention.

What is claimed is:

1. An apparatus for increasing the accuracy of a security system, the apparatus comprising:

an input/output (I/O) interface configured to receive object location information from a first object-locating system and from a second object-locating system, the first object-locating system being capable of locating at least cooperative objects, the second object-locating system being capable of locating at least non-cooperative objects, wherein a cooperative object is an object that cooperates with the apparatus by emitting or transmitting at least one signal from a signal emitting or transmitting device that is on or in the cooperative object to the first object-locating system to enable the first object-locating system to locate the cooperative object, the object location information received by the I/O interface from the first object-locating system describing a location of a cooperative object in at least one dimension, the object location information received by the I/O interface from the second object-locating system describing a location of a non-cooperative object in at least one dimension; and a processor configured to perform an object-type determination (OTD) algorithm, the processor processing the object location information to determine whether the location of the cooperative object and the location of the non-cooperative object are the same or at least substantially the same, wherein if the processor determines that the location of the cooperative object is the same or substantially the same as the location of the non-cooperative object, the processor decides that the cooperative object and the non-cooperative object are the same object, and wherein if the processor determines that the location of the cooperative object is not the same or substantially the same as the location of the non-cooperative object, the processor decides that the cooperative object and the non-cooperative object are not the same object.

2. The apparatus of claim 1, wherein if the processor determines that the location of the cooperative object is not the same or substantially the same as the location of the non-cooperative object, the processor causes at least one signal to be sent out via the I/O interface to a security system that indicates to the security system that an alarm device of the security system is to be activated.

3. The apparatus of claim 1, wherein if the processor determines that the location of the cooperative object is the same or substantially the same as the location of the non-cooperative object, the processor causes at least one signal to be sent out via the I/O interface to a security system that indicates to the security system that an alarm device of the security system is not to be activated.

4. The apparatus of claim 1, wherein said at least one signal emitted or transmitted by the signal emitting or transmitting device is an infrared (IR) signal, and wherein the first object-locating system is an infrared (IR) system that uses one or more IR sensors to sense the IR signal.

5. The apparatus of claim 1, wherein said at least one signal emitted or transmitted by the signal emitting or transmitting device is an optical signal, and wherein the first object-locating system is an imaging system that uses at least one optical sensor to sense the optical signal.

6. The apparatus of claim 1, wherein said at least one signal emitted or transmitted by the signal emitting or transmitting device is an acoustical signal, and wherein the first object-locating system is an imaging system that uses at least one acoustical sensor to sense the optical signal.

7. The apparatus of claim 1, wherein said at least one signal emitted or transmitted by the signal emitting or transmitting device is an electromagnetic signal, and wherein the first object-locating system is an electromagnetic system that uses at least one electromagnetic sensor to sense the electromagnetic signal.

8. The apparatus of claim 1, wherein said at least one signal emitted or transmitted by the signal emitting or transmitting device is a radio frequency (RF) signal, and wherein the first object-locating system is an RF system that uses at least one RF receiver to receive the RF signal.

9. The apparatus of claim 8, wherein the signal emitting or transmitting device is an RF identification (RFID) device and said at least one signal emitted or transmitted by the RFID device is an RFID signal, and wherein the RF system is an RFID system that uses at least one RFID receiver to receive and decode the RFID signal.

10. The apparatus of claim 9, wherein the RFID system uses at least two RFID receivers to receive and decode said RFID signal.

11. The apparatus of claim 9, wherein the RFID system uses at least one RFID transceiver and at least one RFID receiver to receive and decode the RFID signal, the RFID transceiver comprising an RFID receiver and an RFID transmitter, the RFID transmitter of the RFID transceiver transmitting at least one RF signal to the RFID device on or in the cooperative object, wherein when the RFID device receives the RF signal transmitted by the RFID transmitter, the RFID device transmits said RFID signal.

12. The apparatus of claim 1, wherein the processor is also configured to determine whether or not object location information associated with one or more particular cooperative objects has been received, wherein if the processor determines that it has not received object location information associated with a particular cooperative objects, the processor generates an indication that indicates that the particular cooperative object cannot currently be located.

13. A method for improving the accuracy of a security system, the method comprising:

receiving object location information from a first object-locating system and from a second object-locating system, the first object-locating system being capable of locating at least cooperative objects, the second object-locating system being capable of locating at least non-cooperative objects, wherein a cooperative object is an object that cooperates with the apparatus by emitting or transmitting at least one signal from a signal emitting or transmitting device that is on or in the cooperative object to the first object-locating system to enable the first object-locating system to locate the cooperative object, the object location information received from the first object-locating system describing a location of a cooperative object in at least one dimension, the object location information received from the second object-locating system describing a location of a non-cooperative object in at least one dimension; and processing the object location information received from the first and second object-locating systems to determine whether or not the location of the cooperative object is the same or at least substantially the same as the location of the non-cooperative object wherein if it is determined that the location of the cooperative object is the same or substantially the same as the location of the non-cooperative object, then a decision is made that the cooperative object and the non-cooperative object are the same object, and wherein if it is determined that the location of the cooperative object is not the same or substantially the same as the location of the non-cooperative object, then it is decided that the cooperative object and the non-cooperative object are not the same object.

14. The method of claim 13, further comprising:

causing an alarm device to be activated if a determination is made during said processing that the location of the cooperative object is not the same or substantially the same as the location of the non-cooperative object.

15. The method of claim 13, further comprising:

preventing an alarm device from being activated if a determination is made during said processing that the location of the cooperative object is the same or substantially the same as the location of the non-cooperative object.

16. The method of claim 13, wherein said at least one signal emitted or transmitted by the signal emitting or transmitting device is an infrared (IR) signal, and wherein the first object-locating system is an infrared (IR) system that uses one or more IR sensors to sense the IR signal.

17. The method of claim 13, wherein said at least one signal emitted or transmitted by the signal emitting or transmitting device is an optical signal, and wherein the first object-locating system is an imaging system that uses at least one optical sensor to sense the optical signal.

18. The method of claim 13, wherein said at least one signal emitted or transmitted by the signal emitting or transmitting device is an electromagnetic signal, and wherein the first object-locating system is an electromagnetic system that uses at least one electromagnetic sensor to sense the electromagnetic signal.

19. The method of claim 13, wherein said at least one signal emitted or transmitted by the signal emitting or transmitting device is a radio frequency (RF) signal, and wherein the first object-locating system is an RF system that uses at least one RF receiver to receive the RF signal.

20. The method of claim 19, wherein the signal emitting or transmitting device is an RF identification (RFID) device and said at least one signal emitted or transmitted by the RFID device is an RFID signal, and wherein the RF system is an RFID system that uses at least one RFID receiver to receive and decode the RFID signal.

21. The method of claim 20, wherein the RFID system uses at least two RFID receivers to receive and decode said RFID signal.

22. The method of claim 20, wherein the RFID system uses at least one RFID transceiver and at least one RFID receiver to receive and decode the RFID signal, the RFID transceiver comprising an RFID receiver and an RFID transmitter, the RFID transmitter of the RFID transceiver transmitting at least one RF signal to the RFID device on or in the cooperative object, wherein when the RFID device receives the RF signal transmitted by the RFID transmitter, the RFID device transmits said RFID signal.

23. The method of claim 13, further comprising:

determining whether or not object location information associated with one or more particular cooperative objects has been received, wherein if a determination is made that object location information associated with a particular cooperative object has not been received, generating an indication that indicates that the particular cooperative object cannot currently be located.

24. A computer program for preventing a false alarm from occurring in a security system, the computer program being embodied on a computer-readable medium, the program comprising:

instructions for receiving object location information from a first object-locating system and from a second object-locating system, the first object-locating system being capable of locating at least cooperative objects, the second object-locating system being capable of locating at least non-cooperative objects, wherein a cooperative object is an object that cooperates with the apparatus by emitting or transmitting at least one signal from a signal emitting or transmitting device that is on or in the cooperative object to the first object-locating system to enable the first object-locating system to locate the cooperative object, the object location information received from the first object-locating system describing a location of a cooperative object in at least one dimension, the object location information received from the second object-locating system describing a location of a non-cooperative object in at least one dimension; and instructions for processing the object location information received from the first and second object-locating systems to determine whether or not the location of the cooperative object is the same or at least substantially the same as the location of the non-cooperative object, wherein if it is determined that the location of the cooperative object is the same or substantially the same as the location of the non-cooperative object, then a decision is made that the cooperative object and the non-cooperative object are the same object, and wherein if it is determined that the location of the cooperative object is not the same or substantially the same as the location of the non-cooperative object, then it is decided that the cooperative object and the non-cooperative object are not the same object.

* * * * *